US005474969A

United States Patent [19]

Hastreiter, Jr. et al.

[11] Patent Number: 5,474,969

[45] Date of Patent: Dec. 12, 1995

[54] OVERCOAT FOR THERMAL DYE TRANSFER RECEIVING ELEMENT

[75] Inventors: Jacob J. Hastreiter, Jr., Spencerport; William H. Simpson, Pittsford; Linda Kaszczuk, Webster, all of N.Y.

[73] Assignee: Eastman Kodak Company, Rochester, N.Y.

[21] Appl. No.: 345,102

[22] Filed: Nov. 28, 1994

[51] Int. Cl.[6] ..... B41M 5/035; B41M 5/38

[52] U.S. Cl. ..... 503/227; 428/195; 428/341; 428/412; 428/913; 428/914

[58] Field of Search ..... 8/471; 428/195, 428/341, 412, 913, 914; 503/227

[56] References Cited

FOREIGN PATENT DOCUMENTS 5-286265 11/1993 Japan ..... 503/227

*Primary Examiner*—B. Hamilton Hess
*Attorney, Agent, or Firm*—Harold E. Cole

[57] ABSTRACT

A dye-receiving element for thermal dye transfer comprising a support having on one side thereof a dye image-receiving layer, wherein the dye image-receiving layer is overcoated with a layer consisting of a water-soluble poly(ethylene oxide) polymer.

12 Claims, No Drawings

OVERCOAT FOR THERMAL DYE TRANSFER RECEIVING ELEMENT

This invention relates to dye-receiving elements used in thermal dye transfer, and more particularly to the use of an aqueous overcoat for the dye image-receiving layers for such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye receiving elements used in thermal dye transfer generally include a support (transparent or reflective) having on one side thereof a dye image-receiving layer. The dye image-receiving layer conventionally comprises a polymeric material chosen from a wide assortment of compositions for its compatibility and receptivity for the dyes to be transferred from the dye donor element.

Polycarbonates have been found to be desirable image-receiving layer polymers because of their effective dye compatibility and receptivity, as disclosed in U.S. Pat. Nos. 4,748,150, 4,965,238, 4,965,239, 4,965,241 and 4,695,286. The polycarbonate receiving layer may also be overcoated with a second polymeric layer for protection against dye fade.

Retransfer is a potential image stability problem with thermal dye transfer images. The receiver must act as a medium for dye diffusion at elevated temperatures, yet the transferred image dye must not be allowed to migrate from the final print. Retransfer is observed when another surface comes into contact with a final print. Such surfaces may include paper, plastics, binders, backside of (stacked) prints, and some album materials.

Another problem is that images created by thermal dye transfer techniques have a propensity to degrade when stored in poly(vinyl chloride) (PVC) folders or sleeves. Wherever direct contact is established between the image and PVC, plastisizers present in the PVC act on the imaged dyes. These plastisizers solubilize the image dye thereby allowing the dye to diffuse out from the receiver medium into the PVC folders or sleeves. When a PVC cover is removed from a thermal dye transfer image, distinct areas are observed where the image dye has migrated into the PVC. While polymeric overcoats may provide adequate protection against dye fade, they offer minimal protection against retransfer of the dyes to PVC cover sheets.

JP 5-286265 discloses a thermal dye image-receiver sheet wherein a synthetic paper support is coated with a water-absorbent material. Included within the list of water-absorbent materials are "polyoxyethylene types". It is indicated that the amount of such material in the image-receiving layer should not exceed 30 wt %, or else there would be a deficiency in density. However, as will be shown by comparative tests hereafter, an overcoat of such material in a greater amount has improved retransfer-inhibiting properties.

It is an object of this invention to provide a receiver element for thermal dye transfer which has improved resistance to retransfer, especially to PVC covers.

These and other objects are achieved in accordance with this invention which comprises a dye-receiving element for thermal dye transfer comprising a support having on one side thereof a dye image-receiving layer, wherein the dye image-receiving layer is overcoated with a layer consisting of a water-soluble poly(ethylene oxide) polymer.

In a preferred embodiment of the invention, the poly(ethylene oxide) polymer has a molecular weight of at least about 900,000. The poly(ethylene oxide) can be coated in any amount which is effective for the intended purpose. In general, good results have been achieved at a coverage of about 0.108 $g/m^2$ to 0.430 $g/m^2$.

By overcoating an image-receiving layer or a previously applied overcoat top layer with a water-soluble poly(ethylene oxide) layer, superior protection is provided for the thermally generated image, and the amount of dye transferred to PVC is significantly reduced. Additionally, with the use of poly(ethylene oxide) as overcoat, improvement in the thermal printing efficiency is also achieved.

A preferred polycarbonate for use in a receiving layer of the invention is a bisphenol-A polycarbonate such as LEXAN 141-112® (General Electric Co.) and Makrolon 5700® (Miles Labs).

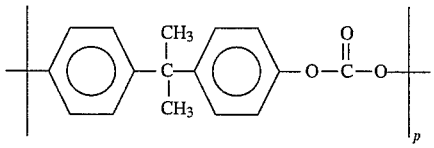

Lexan 141-112®: p~120

Makrolon 5700®: p~280

The support for the dye-receiving element of the invention may be transparent or reflective, and may comprise a polymeric, a synthetic paper, or a cellulosic paper support, or laminates thereof. Examples of transparent supports include films of poly(ether sulfone)s, polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference.

The dye image-receiving layer may be present in any amount which is effective for its intended purpose. In general, good results have been obtained at a receiver layer concentration of from about 0.5 to about 10 g/m$^2$.

Resistance to sticking during thermal printing may be enhanced by the addition of release agents to the dye receiving layer or to an overcoat layer, such as silicone based compounds, as is conventional in the art.

Dye-donor elements that are used with the dye-receiving element of the invention conventionally comprise a support having thereon a dye-containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following examples are provided to further illustrate the invention.

EXAMPLE 1

A receiver coating was prepared consisting of a subbed base material, as described in U.S. Pat. No. 5,244,861, coated with a polycarbonate dye-receiving layer which was overcoated with a polymeric layer to provide fade protection. Samples of this receiver were then machine overcoated with a third layer consisting of poly(ethylene oxide) (Scientific Polymer Products, Inc., Ontario, N.Y., Cat. No. 343) having an approximate molecular weight of 900,000. Coverage levels for the poly(ethylene oxide) were 0.108, 0,215, and 0.430 g/m$^2$, respectively. The control for the series was a sample of receiver which was not overcoated with the poly(ethylene oxide).

Control 1

A dye-receiving layer comprising Makrolon KL3-1013® polyether-modified bisphenol A polycarbonate (Bayer AG) (1.78 g/m$^2$) and Lexan 141-112® bisphenol A polycarbonate (General Electric Co. ) (1.44 g/m$^2$), dibutyl phthalate (Eastman Kodak Co.) (0.32 g/m$^2$), diphenyl phthalate (Eastman Kodak Co. ) (0.32 g/m$^2$), Fluorad FC-431® perfluoroamido surfactant (3M Corp. ) (0.012 g/m$^2$) was coated from a mixed solvent of dichloromethane and trichloroethylene. This receiver layer was overcoated with a polymeric layer consisting of polydimethylsiloxane-modified bisphenol A polycarbonate (structure shown below) (0.215 g/m$^2$), Fluorad FC-431® (0.016 g/m$^2$) and DC-510 silicone fluid surfactant (Dow Corning Co.) (0.009 g/m$^2$) dissolved in a dichloromethane and trichloroethylene solvent mixture.

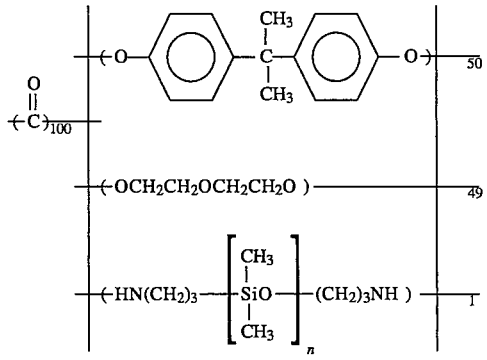

where n is ~55–65

A linear condensation polymer considered to be derived from carbonic acid, bisphenol A, diethylene glycol, and aminopropyl-terminated polydimethylsiloxane.

Sample 1

The dye-receiving layer as described in Control 1 was overcoated with an additional layer consisting of poly(ethylene oxide) (0.108 g/m$^2$) and 10 G Surfactant (a polyglycidol surfactant from Olin Corp.) (0.017 /gm$^2$) dissolved in deionized water.

Sample 2

The dye-receiving layer as described in Control 1 was overcoated with an additional layer consisting of poly(ethylene oxide) (0.215 g/m$^2$) and 10 G Surfactant (0.017 /gm$^2$) dissolved in deionized water.

Sample 3

The dye-receiving layer as described in Control 1 was overcoated with an additional layer consisting of poly(ethylene oxide) (0.430 /gm$^2$) and 10 G Surfactant (0.017 g/m$^2$) dissolved in deionized water.

A dye-donor element of sequential areas of cyan, magenta and yellow dye was prepared using the same dyes and materials as shown in U.S. Pat. No. 5,262,378, column 6, line 42 through column 7, line 68.

The imaged prints were prepared by placing the dye-donor element in contact with the polymeric dye-receiving layer side of the receiver element. The assemblage was fastened to the top of the motor driven 53 mm diameter rubber roller. A TDK thermal head, L-231, thermostated at 30° C. was pressed with a force of 36N against the dye-donor element side of the assemblage pushing it against the rubber roller. The TDK L-231 thermal print head has 512 independently addressable heaters with a resolution of 5.4 dots/mm, an active printing width of 95 mm and an average heater resistance of 512 ohms. The imaging electronics were activated and the assemblage was drawn between the print head and roller at 20.6 mm/s. Coincidentally, the resistive elements in the thermal print head were pulsed on for 128 μs. Printing maximum density requires 127 pulses "on" time per printed line of 17 ms. When the voltage supplied was 10.7 volts, a maximum total energy required to print a 2.3 Dmax density was 3.7 mJ/dot. It was necessary to increase the voltage to 13.0 volts for Formulations A and B in Table 8, which results in a maximum total energy of 5.4 mJ/dot in order to achieve densities great enough to allow evaluation of the PVC retransfer test. The images were printed with a 1:1 aspect ratio. This printing scheme was repeated in succession for each of the three-color dye-donor elements.

The thermally transferred image consisted of a uniform density patch with an area of approximately 10 $cm^2$ as well as a step wedge gradient.

Following printing, each of the imaged receiver samples was covered with a sheet of plasticized PVC. The imaged, PVC-covered samples were then stacked and placed into a polyethylene-lined foil envelope and submitted for incubation of 7 days duration at 50° C. and 50% relative humidity. The envelope containing the samples was left unsealed to allow for humidity equilibration between the stacked samples and the incubation chamber. A one kilogram (70–75 $kg/m^2$) weight was placed on top of the stacked receiver at the start of the incubation and removed only at the conclusion when the samples were removed from the incubation chamber.

Following incubation, the PVC sheet was removed from each of the imaged receivers. Red, green and blue Status A transmission density measurements on the PVC corresponding to the location of the uniform density patch were taken before and after incubation using an X-Rite densitometer (X-Rite Inc., Grandville, Mich.) to determine the quantity of dye which had diffused into the PVC. The corresponding transmission densities for the PVC used in the tests and prior to incubation were 0.02 for all three colors. The following results were obtained:

TABLE 1

| Transferred Images to PVC | | | |
|---|---|---|---|
| Poly(Ethylene Oxide) | Status A Transmission Density | | |
| Overcoat ($g/m^2$) | Red | Green | Blue |
| 0.00 (Control 1) | 0.08 | 0.09 | 0.09 |
| 0.108 (Sample 1) | 0.04 | 0.04 | 0.05 |
| 0.215 (Sample 2) | 0.02 | 0.02 | 0.02 |
| 0.430 (Sample 3) | 0.02 | 0.02 | 0.02 |

The above data illustrates the advantage of a poly(ethylene oxide) overcoat in reducing the amount of dye retransferred to PVC.

An unforeseen benefit of using poly(ethylene oxide) as an overcoat is the improvement realized in thermal printing efficiency. A second set of images was prepared as described above. Densitometric measurements on the transferred image for the step wedge gradients were obtained using an X-Rite densitometer with Status A reflection filters. Red, green or blue density values were recorded depending on the image dye in the following Tables 2, 3 and 4:

TABLE 2

| Status A Red Density | | | | |
|---|---|---|---|---|
| Step No. | Control 1 no PEO overcoat | Sample 1 0.108 $g/m^2$ PEO | Sample 2 0.215 $g/m^2$ PEO | Sample 3 0.430 $g/m^2$ PEO |
| 1 | 0.12 | 0.14 | 0.14 | 0.14 |
| 2 | 0.12 | 0.14 | 0.15 | 0.18 |
| 3 | 0.13 | 0.18 | 0.23 | 0.35 |
| 4 | 0.19 | 0.36 | 0.42 | 0.55 |
| 5 | 0.35 | 0.47 | 0.54 | 0.60 |
| 6 | 0.53 | 0.60 | 0.67 | 0.75 |
| 7 | 0.70 | 0.76 | 0.84 | 0.94 |
| 8 | 1.05 | 1.02 | 1.11 | 1.21 |
| 9 | 1.46 | 1.43 | 1.57 | 1.64 |

TABLE 3

| Status A Green Density | | | | |
|---|---|---|---|---|
| Step No. | Control 1 no PEO overcoat | Sample 1 0.108 $g/m^2$ PEO | Sample 2 0.215 $g/m^2$ PEO | Sample 3 0.430 $g/m^2$ PEO |
| 1 | 0.12 | 0.12 | 0.12 | 0.12 |
| 2 | 0.12 | 0.13 | 0.14 | 0.16 |
| 3 | 0.12 | 0.16 | 0.18 | 0.26 |
| 4 | 0.25 | 0.36 | 0.44 | 0.53 |
| 5 | 0.46 | 0.55 | 0.61 | 0.67 |
| 6 | 0.64 | 0.73 | 0.81 | 0.83 |
| 7 | 0.88 | 0.95 | 1.04 | 1.09 |
| 8 | 1.23 | 1.29 | 1.41 | 1.47 |
| 9 | 1.72 | 1.78 | 1.81 | 1.94 |

TABLE 4

| Status A Blue Density | | | | |
|---|---|---|---|---|
| Step No. | Control 1 no PEO overcoat | Sample 1 0.108 $g/m^2$ PEO | Sample 2 0.215 $g/m^2$ PEO | Sample 3 0.430 $g/m^2$ PEO |
| 1 | 0.10 | 0.11 | 0.13 | 0.10 |
| 2 | 0.10 | 0.11 | 0.14 | 0.13 |
| 3 | 0.10 | 0.16 | 0.23 | 0.29 |
| 4 | 0.25 | 0.37 | 0.48 | 0.52 |
| 5 | 0.49 | 0.56 | 0.64 | 0.69 |
| 6 | 0.65 | 0.72 | 0.80 | 0.84 |
| 7 | 0.86 | 0.94 | 1.02 | 1.04 |
| 8 | 1.18 | 1.24 | 1.30 | 1.39 |
| 9 | 1.59 | 1.65 | 1.70 | 1.71 |

The above results illustrate the improved transfer efficiency of dye to the receiver achieved with poly(ethylene oxide) (PEO) overcoats (higher density at each step in almost all instances).

EXAMPLE 2

Comparative Test

JP 5-286265 discloses that the introduction of hydrophilic materials into the dye-receiving layer, or an overcoat, of a heat transfer image-receiving sheet improves the quality of the print and produces a texture similar to that of ordinary paper. The publication also teaches that if the dye image-receiving layer contains over 30% by weight of the hydrophilic material, then the image quality will be poor.

A comparative test was performed to reproduce the example (Formulation A) given in the above application by preparing a coating melt from the materials described. A second sample (Formulation B) was prepared in a similar manner by increasing the level of the hydrophilic material to 32% by weight. Samples of each coating were evaluated for transfer efficiency and PVC retransfer as in Example 1 above relative to a sample having an overcoat of 100% by weight of a hydrophilic material as described in this invention.

| | Formulation A (parts by weight) | Formulation B (parts by weight) |
|---|---|---|
| vinyl chloride/vinyl acetate copolymer (1000AKT, Denki Kagaku Kogyo K. K.) | 100 | 100 |
| epoxy-modified silicone (KF-393, Nobugoshi Kagaku K. K.) | 3 | 3 |
| amino-modified silicone (KP-343, Nobugoshi Kagaku K. K.) | 3 | 3 |
| toluene/methyl ethyl ketone (1:1 weight ratio) | 400 | 800 |
| poly(vinyl alcohol)/poly-acrylate resin (hydrophilic material) (Sumica Gel, Sumitomo Kagaku K. K.) | 3 | 50 |

TABLE 5

| | Status A Red Density | | | | | |
|---|---|---|---|---|---|---|
| Step No. | Control no PEO overcoat | Sample 1 0.108 g/m² PEO | Sample 2 0.215 g/m² PEO | Sample 3 0.430 g/m² PEO | Formulation A | Formulation B |
| 1 | 0.12 | 0.14 | 0.14 | 0.14 | 0.10 | 0.09 |
| 2 | 0.12 | 0.14 | 0.15 | 0.18 | 0.10 | 0.09 |
| 3 | 0.13 | 0.18 | 0.23 | 0.35 | 0.10 | 0.09 |
| 4 | 0.19 | 0.36 | 0.42 | 0.55 | 0.11 | 0.09 |
| 5 | 0.35 | 0.47 | 0.54 | 0.60 | 0.14 | 0.10 |
| 6 | 0.53 | 0.60 | 0.67 | 0.75 | 0.25 | 0.12 |
| 7 | 0.70 | 0.76 | 0.84 | 0.94 | 0.34 | 0.14 |
| 8 | 1.05 | 1.02 | 1.11 | 1.21 | 0.49 | 0.17 |
| 9 | 1.46 | 1.43 | 1.57 | 1.64 | 0.67 | 0.20 |

TABLE 6

| | Status A Green Density | | | | | |
|---|---|---|---|---|---|---|
| Step No. | Control no PEO overcoat | Sample 1 0.108 g/m² PEO | Sample 2 0.215 g/m² PEO | Sample 3 0.430 g/m² PEO | Formulation A | Formulation B |
| 1 | 0.12 | 0.12 | 0.12 | 0.12 | 0.10 | 0.09 |
| 2 | 0.12 | 0.13 | 0.14 | 0.16 | 0.10 | 0.09 |
| 3 | 0.12 | 0.16 | 0.18 | 0.26 | 0.10 | 0.09 |
| 4 | 0.25 | 0.36 | 0.44 | 0.53 | 0.10 | 0.09 |

TABLE 6-continued

| | Status A Green Density | | | | | |
|---|---|---|---|---|---|---|
| Step No. | Control no PEO overcoat | Sample 1 0.108 g/m² PEO | Sample 2 0.215 g/m² PEO | Sample 3 0.430 g/m² PEO | Formulation A | Formulation B |
| 5 | 0.46 | 0.55 | 0.61 | 0.67 | 0.12 | 0.09 |
| 6 | 0.64 | 0.73 | 0.81 | 0.83 | 0.19 | 0.10 |
| 7 | 0.88 | 0.95 | 1.04 | 1.09 | 0.27 | 0.12 |
| 8 | 1.23 | 1.29 | 1.41 | 1.47 | 0.37 | 0.14 |
| 9 | 1.72 | 1.78 | 1.81 | 1.94 | 0.52 | 0.16 |

TABLE 7

| | Status A Blue Density | | | | | |
|---|---|---|---|---|---|---|
| Step No. | Control no PEO overcoat | Sample 1 0.108 g/m² PEO | Sample 2 0.215 g/m² PEO | Sample 3 0.430 g/m² PEO | Formulation A | Formulation B |
| 1 | 0.10 | 0.11 | 0.13 | 0.10 | 0.10 | 0.07 |
| 2 | 0.10 | 0.11 | 0.14 | 0.13 | 0.10 | 0.07 |
| 3 | 0.10 | 0.16 | 0.23 | 0.29 | 0.10 | 0.07 |
| 4 | 0.25 | 0.37 | 0.48 | 0.52 | 0.10 | 0.07 |
| 5 | 0.49 | 0.56 | 0.64 | 0.69 | 0.12 | 0.08 |
| 6 | 0.65 | 0.72 | 0.80 | 0.84 | 0.18 | 0.09 |
| 7 | 0.86 | 0.94 | 1.02 | 1.04 | 0.24 | 0.10 |
| 8 | 1.18 | 1.24 | 1.30 | 1.39 | 0.33 | 0.11 |
| 9 | 1.59 | 1.65 | 1.70 | 1.71 | 0.44 | 0.12 |

The above results tabulated in Tables 5, 6 and 7 indicate that the image density of both receiver samples (Formulations A and B) are substantially less than that of this invention at each step when printed under the same conditions.

TABLE 8

| Transferred Images to PVC* | | | |
|---|---|---|---|
| Poly(Ethylene Oxide) | Status A Transmission Density | | |
| Overcoat (g/m²) | Red | Green | Blue |
| 0 (Control) | 0.08 | 0.09 | 0.09 |
| 0.108 | 0.04 | 0.04 | 0.05 |
| 0.215 | 0.02 | 0.02 | 0.02 |
| 0.430 | 0.02 | 0.02 | 0.02 |
| Formulation A | 0.37 | 0.30 | 0.23 |
| Formulation B | 0.07 | 0.05 | 0.03 |

*PVC density is 0.02 in each color.

The above results indicate that the amount of dye retransfer from the print to a PVC sleeve, when incubated at 50° C. and 50% R.H. under a one kilogram weight, is higher with dye-receiving elements containing Formulations A and B than it is with the dye-receiving elements of this invention. In addition, visual examination indicates an unacceptable level of mottle in the dye-receiving elements containing Formulations A and B.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof a dye image-receiving layer, wherein the dye image-receiving layer is overcoated with a layer consisting of a water-soluble poly(ethylene oxide) polymer.

2. The element of claim 1 wherein said poly(ethylene oxide) polymer has a molecular weight of at least about 900,000.

3. The element of claim 1 wherein said poly(ethylene oxide) is coated at a coverage of about 0.108 $g/m^2$ to 0.430 $g/m^2$.

4. The element of claim 1 wherein the dye image-receiving layer is a bisphenol-A polycarbonate having a number molecular weight of at least about 25,000.

5. A process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer, wherein the dye image-receiving layer is overcoated with a layer consisting of a water-soluble poly(ethylene oxide) polymer.

6. The process of claim 5 wherein said poly(ethylene oxide) polymer has a molecular weight of at least about 900,000.

7. The process of claim 5 wherein said poly(ethylene oxide) is coated at a coverage of about 0.108 $g/m^2$ to 0.430 $g/m^2$.

8. The process of claim 5 wherein the dye image-receiving layer is a bisphenol-A polycarbonate having a number molecular weight of at least about 25,000.

9. A thermal dye transfer assemblage comprising:

(a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer; wherein the dye image-receiving layer is overcoated with a layer consisting of a water-soluble poly(ethylene oxide) polymer.

10. The assemblage of claim 9 wherein said poly(ethylene oxide) polymer has a molecular weight of at least about 900,000.

11. The assemblage of claim 9 wherein said poly(ethylene oxide) is coated at a coverage of about 0.108 $g/m^2$ to 0.430 $g/m^2$.

12. The assemblage of claim 9 wherein the dye image-receiving layer is a bisphenol-A polycarbonate having a number molecular weight of at least about 25,000.

* * * * *